United States Patent [19]

Träubel et al.

[11] 4,126,413

[45] Nov. 21, 1978

[54] TANNING WITH CARBOXYLIC ACID CARRYING ESTER, URETHANE AND/OR AMIDE GROUP

[75] Inventors: Harro Träubel, Leverkusen; Helga Heinze, Cologne, both of Germany

[73] Assignee: Bayer Aktiengesellschaft, Leverkusen, Germany

[21] Appl. No.: 802,101

[22] Filed: May 31, 1977

[51] Int. Cl.[2] ..... C14C 3/06

[52] U.S. Cl. ..... 8/94.26; 8/94.27

[58] Field of Search ..... 8/94.26, 94.27

[56] References Cited

U.S. PATENT DOCUMENTS

| | | | |
|---|---|---|---|
| 2,205,883 | 6/1940 | Graves | 8/94.21 |
| 4,042,321 | 8/1977 | Backer et al. | 8/94.26 |

FOREIGN PATENT DOCUMENTS

| | | |
|---|---|---|
| 1,233,975 | 2/1967 | Fed. Rep. of Germany. |
| 7,505,743 | 11/1975 | Netherlands. |

OTHER PUBLICATIONS

Journal of the International Society of Leather Trades' Chemists, 1943, 27, pp. 83–84.

*Primary Examiner*—A. Lionel Clingman

*Attorney, Agent, or Firm*—Sprung, Felfe, Horn, Lynch & Kramer

[57] ABSTRACT

In the tanning or re-tanning of a hide with a tanning composition comprising a tanning-active substance and at least one of a Cr(III) salt, a dicarboxylic acid, a dicarboxylic acid salt, an emulsifier and an acid-binding agent, the improvement which comprises employing as said tanning-active substance a carboxylic acid carrying at least one of an ester, urethane or amide group. Advantageously the agent has at least two carboxyl groups per molecule and a molecular weight of about 170 to 30,000, preferably 310 to 10,000. The products are softer and better through-tanned and there is maximum utilization of chromium, thereby minimizing the waste disposal problem.

7 Claims, No Drawings

TANNING WITH CARBOXYLIC ACID CARRYING ESTER, URETHANE AND/OR AMIDE GROUP

This invention relates to a process for the tanning or re-tanning and, more especially, for the chrome-tanning, of limed stock or leather using carboxylic acids containing ester and/or urethane and/or amide groups.

The use of carboxylic acids for tanning has long been known. According to German Patent Specification No. 679,484 for example, tanning is carried out with basic iron salt liquors in the presence of citric acid. In addition, compounds containing carboxyl groups have been used in particular in the deliming or oiling of leathers (cf. for example German Patent Specification No. 721,684, U.S. Patent Specification No. 2,205,883). Re-tanning agents for leather are described in German Auslegeschrift No. 1,233,975. These re-tanning agents are derived from phenols, the phenolic OH-group being replaced by radicals corresponding to the general formula $—O—(RO)_x—CO—R'—(COOMe)_y$.

Tanning with Cr(III)-salts is particularly important. Carboxylic acids have also been used in chrome-tanning processes such as these (cf. for example Stather, Gerbereichemie und -technologie, 1967, pages 417 and 477).

Residual liquors with a relatively high chromium oxide content, for example ranging from 6 to 10 g of $Cr_2O_3$ per liter, accumulate in chrome-tanning processes. In all about 20 to 30% of the original chromium oxide is left behind unused in the residual liquors. In addition to the economic disadvantage involved, this incomplete utilization presents the leather manufacturer with difficulties when it comes to effluent treatment.

Accordingly, there has been no shortage of attempts to improve the degree of utilization of the residual liquors. For example, it has been proposed to reuse the liquor left behind after tanning following the addition of powder-form chrome-tanning agents. However, this process is complicated and leather fibers and salts accumulate to an increasing extent in the repeatedly used liquors. In cases where neutralizing mixtures or other additives which form insoluble compounds are used, they gradually accumulate and interfere with the tanning process.

Increasing the pH-value of the tanning liquors increases the affinity of the chrome-tanning agents for the skin. Accordingly, it is readily possible to obtain better utilization of the chrome-tanning agents by correspondingly increasing the pH-value of the liquors. Unfortunately, the increased astringency of the chrome-tanning agents leads to grainy, i.e. inadequately smooth, leathers.

It has also been proposed to use so-called crosslinking dicarboxylic acids, for example succinic acid, adipic acid, in the pickling liquor or in the chrome-tanning liquor (cf. for example Das Leder, Vol. 23, 1972, page 174, and Journ. of the Internat. Soc. of Leather Trades Chemists, Vol. 27, (1943), page 83). In cases where dicarboxylic acids such as these are used in the pickling liquor, the rate of penetration of the chrome-tanning agents into the skin is slowed down, giving rise, especially in the case of non-split hides, to tanning difficulties and to an uneven distribution of chromium throughout the cross-section of the hide. In chrome-tanning itself, these acids are used in solution in the form of their sodium salts with the chrome-tanning agents. It is only possible to use quantities of up to about 1.5 mole per mole of $Cr_2O_3$, because the solutions are only briefly stable and lead to precipitations in the pH- and concentration ranges required for carrying out chrome-tanning on a commercial scale.

Application Ser. No. 573,282, filed Apr. 29, 1975, now U.S. Pat. No. 4,042,321, the disclosure of which is incorporated herein by reference, describes chrome-tanning processes in which the chrome utilization of the residual liquors is considerably improved by carrying out tanning in the presence of aliphatic or aromatic dicarboxylic acids and by maintaining certain conditions in regard to concentration and pH-value.

Applicants' efforts to improve and simplify known processes have now culminated in the discovery of a process for tanning and/or re-tanning smooth skins and/or leather with tanning-active subtances and dicarboxylic acids or salts thereof, more especially in conjunction with Cr(III)salts, which is characterized by the fact that carboxylic acids containing ester and/or urethane and/or amide groups are used as the tanning-active substances.

These carboxylic compounds with ester, amide and/or urethane groups as such are very suitable tanning agents. They may be used as softening tanning agents or as fat liquoring compounds with tanning properties.

The preferred embodiment of this invention, however, is the use in combination with tanning active Cr(III)-compounds. Here they fulfil two important properties:

(1) better exhaustion of the residual chrome liquors, (2) softening the leather without losening the grain.

Hydrophilicity or hydrophobicity may be influenced as required by means of the starting compounds used. If, for example, 1,6-hexane diol or even longer chain diols, for example, 1,12-dodecane diol are used as the alcoholic component, highly hydrophobic compounds which only dissolve slowly in water are obtained. In cases where Cr(III)salts, for example, are used, it is possible in this way to retard formation of the chromium complexes which, in the case of thick smoothed skins, is reflected in improved through-tanning. The hydrophobicity or hydrophilicity of the finished leather may also be positively influenced.

In general polyaddition, polymerization and polycondensation compounds are suitable as higher molecular compounds containing at least 2 carboxylic acid groups. Examples of such compounds are (co)polymers of (poly)carboxylic acids unsaturated in one or more position combined with their own kind or with other unsaturated compounds, (form)aldehyde condensation products from possibly substituted, aromatic carbonic acids or polyisocyanate or polyepoxide addition products combined with aminocarbonic acids.

The molar weight of the (co)polymer should preferably be chosen so that it is below 50,000, preferably under 10,000. Since the aim should be for the COOH groups of the polymer to lie as close as possible to each other, the proportion of monomers containing COOH groups should be as high as possible. It should preferably be more than 10 molar % of the finished (co)polymer.

Suitable compounds are, in general, known and are described, for example, in Houben Weyl's "Methoden der Organischen Chemie", Makromolekulare Stoffe 1 und 2 ("Methods of Organic Chemistry", Macromolecular Substances 1 and 2), Stuttgart 1961. Polyesters containing carboxylic acid groups, or possibly exhibiting NH groups are, however, preferred because they at the same time exert softening properties on the leather.

The process according to the invention enables a much softer quality of leather to be obtained. In addition, it is possible to obtain considerably better through-tanning of the leathers by comparison with conventional processes. Since, in addition, extremely good utilization of the chromium liquors is also obtained, the tanning process according to the invention affords considerable advantages and is considerably superior to conventional processes.

The materials used for the process according to the invention may be obtained by methods known per se (cf. for example E. Muller, Houben-Weyl, "Methoden der organischen Chemie", Vol. XIV/2, 1963, pages 16 et seq). Thus, the products containing carboxy groups may be obtained by reacting compounds containing hydroxy and/or amino groups in the following molar ratio:

$$\frac{-COOH}{NH_2 + OH} \geqq 1$$

The molecular weight of the resulting product generally amounts to more than about 170 and less than about 100,000; the substances contain at least two COOH-groups.

Since, when subjected to polycondensation, these compounds never condense unequivocally to form the theoretically calculable products, the formation of products of even higher molecular weight is not ruled out.

However, it is preferred to use products of which more than about 90% are in the molecular weight range from about 170 to about 30,000 and, with particular preference, in the range from about 310 to about 10,000.

The resulting substances may be represented for example by the following general formula:

X — COOH in which X may represent the following radicals

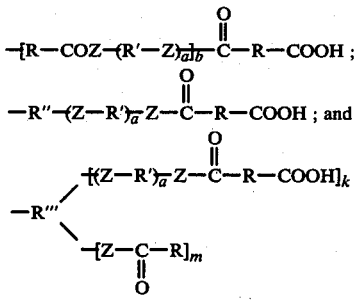

$a$ and $b$ are 0 or integers from 1 to about 100, preferably from 1 to about 20, $k$ and $m$ are 0 or integers from 1 to about 6, $k$ and $m$ generally being less than or equal to 6; $n$ is 0 or an integer from 1 to about 20;

R represents $-(CH_2)_n-$ or an optionally alkyl-substituted phenyl radical;

R′ represents $-(CH_2)_n-C(CH_3)-$ or $-(CH_2)_n-$

R″ represents R or R′

R‴ is the radical of a polyhydric alcohol, for example sorbitol, glycerol or trimethylol propane, Z represents

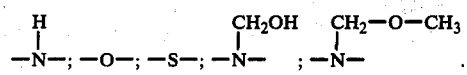

Suitable starting materials are optionally halogenated polycarboxylic acids, preferably dicarboxylic acids, for example, adipic acid, glutaric acid, oxalic acid, malonic acid, maleic acid, terephthalic acid, phthalic acid, isophthalic acid, succinic acid, fumaric acid, aspartic acid and glutamic acid.

The following substances may be used as the hydroxy compound: alcohols such as alkanols, alkenols, alkinols, diols, polyols, amino alcohols and ether alcohols. It is preferred to use glycols such as ethylene glycol, diethylene glycol, triethylene glycol, polyethylene glycol, propylene glycol, dipropylene glycol, polypropylene glycol, butylene glycol, dibutylene glycol, polybutylene glycol, aminoethanol, N-alkyl diethanolamine, stearyl alcohol, oleyl alcohol, trimethylol propane and glycerol and sugar alcohols such as sorbitol.

Compounds containing amido or urethane groups are also suitable for use in the process according to the invention. For example, it is possible to use compounds of the type used for the production of polyester amides, such as diaminoethane, aminoethanol, diaminopropane, diaminohexane, diaminocyclohexane and diaminodicyclohexyl methane.

These amide and/or urethane groups containing compounds are also very suitable in the tanning process. Better softness is, however, achieved by using carboxylic compounds with ester groups.

Tanning is generally carried out as follows:

The smoothed skin, optionally in pickled form, is reacted at room temperature with (based on the weight of the skin) about 3 to 100% of a compound containing carboxyl groups (based on dry weight) in the presence of 0 to about 300% of liquor. Tanning may optionally be accelerated by reducing the pH-value. The pH-value is generally between about 1 and 12 and preferably between about 3 and 10. In cases where Cr(III) compounds are used, the pH-value is between about 1 and 7, preferably between about 3 and 5 and, with particular preference, between about 3.5 and 4.5. The re-tanning of chrome-tanned leathers by standard processes is also possible and gives plump, soft leathers.

In another embodiment, vegetable leathers are re-tanned and adjusted as required in regard to softness, hydrophilicity and hydrophobicity.

The addition of standard emulsifiers for example, alkyl sulfonates, alkyl sulfates, alkyl phenol polyglycol ethers, alkali salts of long-chain alkyl carboxylic acids, quaternised long-chain alkyl ammonium salts, can have a favorable effect upon tanning.

In one particularly preferred embodiment of the present invention, the products containing ester and/or amide and/or urethane groups are used together with chrome-tanning salts. In this way, their tanning and softening effect is developed particularly well.

Chromium(III) salts suitable for pre-tanning are the chromium(III)salts normally used for chrome-tanning, especially chromium(III) sulfates, basic chromium(III) sulfates, also chromium(III)salts masked with organic acids, for example formic acid, acetic acid, self-neutralizing chrome-tanning agents, chrome-tanning agents which, in addition to chromium(III) salts, also contain inorganic salts, such as sodium sulfate or other tanning-active compounds, such as aluminum or zirconium salts or organic tanning agents, or reaction products of hexavalent chromium compounds with reducing agents.

The mixtures used for full tanning preferably contain chromium sulfates and basic chromium sulfates as the chromium-(III)salts. It is also possible to use masked chromium(III)-salts, especially chromium(III)sulfates, which best have only a low degree of masking.

Examples of suitable acid-binding agents are dolomite, alkali carbonates and bicarbonates, alkaline earth metal carbonates, and bicarbonates, magnesium oxide or sodium sulfite.

It is also advisable for chrome-tanning to be carried out in the presence of aliphatic or aromatic dicarboxylic acids, such as, oxalic acid, malonic acid, adipic acid, glutaric acid, sebacic acid, phthalic acid, isophthalic acid, maleic acid and fumaric acid or derivatives of the above-mentioned carboxylic acids or their salts.

Delimed and pickled skins are used in known manner for carrying out the process according to the invention. The chromium(III)salts used for pre-tanning are preferably used in a quantity of at least about 0.2% of $Cr_2O_3$ and, most preferably in a quantity of at least about 0.8% of $Cr_2O_2$, based on the weight of the skin. In a preferred embodiment, pretanning is carried out by actually tanning the skins throughout the entire cross-section.

Full tanning is best carried out in the same bath by adding the mixtures in any form (liquid, solid or dispersed). The components of the mixtures used according to the invention may with advantage be added together. Of these components, it is also possible to add only a few together and also individually. The basic chromium(III) salts are best added first of all either on their own or together with other components. These chromium(III)-salts may also be added together with the chromium(III)salts used for pretanning.

The products used in accordance with the invention may be introduced before, during or after chrome-tanning. It is preferred to introduce the products together with the chromium salts or to add them afterwards. The substances used in accordance with the invention are employed in a quantity of about 0.1 to 100%, preferably in a quantity of about 0.3 to 50% and, with particular preference, in a quantity of about 0.5 to 30%, based on the weight of the skin.

The temperature prevailing during tanning should range from about 5° C. to 50° C. The final temperature normally reaches values of about 10° C. to 50° C., preferably about 20° C. to 46° C.

The process according to the invention is illustrated by the following examples in which the percentages and parts quoted represent percentages by weight and parts by weight, respectively, unless otherwise indicated. (a) Production of the relatively high molecular weight ester and/or polyester containing urethane and/or amide groups.

Polyester A (E. Muller in Houben-Weyl, "Methoden der organischen Chemie" Vol. XIV/2, Stuttgart 1963, pages 16 et seq.)

292 g of adipic acid (2 moles) and 106 g of diethylene glycol (1 mole) were combined in a three-necked flask. The temperature of the mixture was increased from 140° C. to 200° C. over a period of 20 hours. 52 g (54 g is the theoretical yield) of water were eliminated by the introduction of carbon dioxide. The acid number of the polyester was 222.

The following polyesters were produced in the same way as Polyester A:

Table 1

| Polyester | Acid | Glycol | COOH:OH and/or $NH_2$ Molar quantity used |
|---|---|---|---|
| B | adipic acid | dipropylene glycol | 2:1 |
| D | adipic acid octadecanoic acid | trimethylol propane | 5:3 |
| O | adipic acid | 2,5-hexane diol | 2:1 |
| Q | adipic acid | 1,6-hexane diol | 2:1 |
| R | adipic acid | tripropylene glycol | 4:3.3 |
| C | adipic acid | tripropylene glycol | 2:1 |
| T | adipic acid | 1,12-octadecane diol | 2:1 |
| U | adipic acid | 1,2-propylene glycol trimethylol propane | 7:5 |
| V | adipic acid | ethylene glycol | 9:8 |
| W | adipic acid | octaethylene glycol | 2:1 |
| X-1 | adipic acid/ oleic acid | trimethylene propane | 5:3 |
| X-2 | phthalic acid anhydride | dipropylene glycol | 2:1 |
| X-3 | adipic acid terephthalic acid dimethyl ester | hexamethylene diamine tripropylene glycol | 2:1 |

Polyester E 730 g of adipic acid (5 moles) and 480 g of tripropylene glycol (2.5 moles) were heated from 165° C. to 210° C. over a period of 4 hours. The pressure was reduced to 13 mm Hg by means of a hydrogen pump. 88 g of water (theoretical: 90 g) distilled off. The polyester obtained had an acid number of 258 (theoretical: 268).

Polyester E-1

9.8 g of glutaric acid and 9.8 g of solid sodium hydroxide were added to 100 g of polyester E.

Polyester E-2

55 g of glutaric acid were added to 560 g of polyester E followed by the addition at 60° C. of 93 g of ammonia (25% in water).

Polyester E-3

26.7 g of glutaric acid, 19.9 g of sodium hydroxide and 85 g of water were added to 43.8 g of polyester E.

Polyester C 292 g of adipic acid (2 moles) and 192 g of tripropylene glycol (1 mole) were heated from 170° C. to 200° C. over a period of 5 hours, 68 g of water (theoretical: 72 g) distilling off.

Polyester C-1

44 g of glutaric acid and 74.5 g (25% in water) of ammonia were added to 377 g of polyester C.

Polyester F 438 g of adipic acid (3 moles) and 174 g of hexamethylene diamine (1.5 moles) were heated from 150° C. to 240° C. over a period of 15 hours. 55 g of water (theoretical: 56 g) were removed by the introduction of nitrogen.

A 6% solution of this polyester was prepared in 500 g of dimethyl formamide, 300 g of water and 40 g of ammonia (25% in water). The solution had a pH-value of about 8.5.

Polyester Q-1

9.8 g of glutaric acid and 24.3 g of 40% sodium hydroxide were added to 100 g of polyester Q.

Polyester Q-2

467 g of polyester Q, 61 g of adipic acid and 93 g of ammonia (25% in water).

Polyester R-1

57 g of polyester R, 44 g of glutaric acid and 74.5 g of ammonia (25% in water).

Polyester S-1

66 g of glutaric acid and 64 g of sodium hydroxide (40%) were introduced into the mixture of polyester S.

Polyester F-1

50 g of polyester F, 225 g of methanol, 225 g of water and 10 g of formaldehyde (30%), 5 g of potassium hydroxide.

The following products were produced in the same way as polyester F:

| Polyester | Acid | Glycol | COOH:OH and/or $NH_2$ Molar quantity used | |
|---|---|---|---|---|
| G | terephthalic acid dimethyl ester potassium hydroxide | polypropylene glycol ether (OH-number 56) | 50% in ethanol | 2:1 |
| H | adipic acid | glycerol, stearyl alcohol | 8% in DMF/i-propanol (1:1) a mixture of | 3:2 |
| I | adipic acid | bis-hydroxyethoxy-1,4-benzene N-methyl diethanolamine | 6% in 250 g of methylethyl ketone | 3:2 |
| K | terephthalic acid dimethyl ester | 4,4'-diaminodicyclohexyl methane | 6% in DMF/water (1:1) with ammonia to pH 9 | 3:2 |
| L | adipic acid | octaethylene glycol | 35% in water with potassium hydroxide to pH 8 | 2:1 |
| M | malonic-acid-dimethyl ester after removal of the methanol by distillation addition of adipic acid | 2-aminoethanol | 20% in water and ammonia | 3:2 |
| N | phthalic acid anhydride adipic acid | ethylene glycol butine diol | 40% in DMF pH 6 | 13:12 |
| P | adipic acid | triethanolamine | 30% in ammonia water (pH 8) | 3:1 |

Polyester Y 29 g of adipic acid (2 moles) and 192 g of tripropylene glycol (1 mole) were mixed together in a three-necked flask (provided with a thermometer, stirrer and distillation bridge) and heated to 160° C. over a period of 30 minutes by means of a heating mushroom. After another 30 minutes, the temperature was increased to 200°–220° C. and kept at that level for 3.5 hours. 35 g of water distilled off. Distillation of the water was preferably assisted by the introduction of carbon dioxide.

The reaction was then terminated, the reaction mixture left to cool and 275 g of glutaric acid and 204 g of sodium hydroxide in 600 g of water were added at 150° C.

EXAMPLE 1

100% water was added at 20° C. to limed and delimed calfskin. The skin was then tanned for 24 hours with 10% and 30% (solid product, based on the weight of the skin) of polyester F. The leathers were then washed for 10 minutes, fleshed and hung up to dry without oiling. A soft leather with a shrinkage temperature of 60° C. (at 30%) was formed.

EXAMPLE 1 A

A leather tanned in the usual way with chromium-(III)salts was treated for 2 hours at 40° C. with 5% of polyester F in 100% water, followed by fat-liquoring with 2% sulfonated neatsfoot oil. A soft leather was formed.

Dyeing with 0.5% of an anionic acid-resistant dye produced a plump leather with a better dye finish than in the comparison test (without the polyester).

The following tests were carried out in accordance with Example 1 A:

Table 3

| Re-tanning with polyester | | Result |
|---|---|---|
| 5 % dry substance | H | soft, full leather |
| 7 % | L | even-dyed soft leather |
| 9 % | M | very full leather |

EXAMPLE 2

Cowhide limed in the usual way (thickness after splitting: 3.2 mm) was washed for 10 minutes in a tanning drum with 150%, based on the weight of the cowhide, of water at 38° C. The solution was run off. The cowhide was then delimed for 40 minutes in the absence of solution with 3% of ammonium chloride, 0.7% of sodium bisulfite and 0.3% of a standard commercial-grade emulsifier based on nonyl phenol/polyethylene glycol ether, followed by bating for 40 minutes with 0.5% of a standard commercial-grade bate (pH-value 8.0) in the presence of 100% of water at 38° C. A cross-section of the hide does not turn phenolphthalein red in color. The hide was then washed for 10 minutes with 200% of water at 20° C. and the washing liquor thoroughly drained off.

The hide was then pickled in the presence of 11% of water. 5 minutes after the addition of 3% of sodium chloride, the hide was pickled for 90 minutes (pH 3.8) with 0.6% of formic acid (dilution 1:4) and 0.25% of sulfuric acid (dilution 1:8).

9.78% of a powder-form tanning mixture, consisting of 613 parts by weight of powder-form 33% basic chromium sulfate containing 26% of chromium oxide, 41 parts by weight of glutaric acid, 134 parts by weight of sodium glutarate, 69 parts by weight of dolomite, 123 parts by weight of polyester A and 20 parts by weight of nonyl phenol, onto which 30 ethylene oxide groups had been polymerized, were introduced into the pickling liquor, followed by drumming for 8 hours. The final temperature was 45° C., the final pH-value was 3.9 and the residual liquor contained 0.8 g of $Cr_2O_3$/l.

Leathers with a particularly mild feel were obtained after finishing in the usual way.

Instead of glutaric acid and sodium glutarate, phthalic acid, terephthalic acid, adipic acid and sebacic acid and their sodium, potassium or ammonium salts were also used in accordance with this example. In every case, maximum utilization levels of 0.8 g of $Cr_2O_3$/l were obtained.

EXAMPLE 3

Cowhides (unsplit) limed in the usual way were washed for 10 minutes in a tanning vessel with 200% of water at 38° C., based on the weight of the hides. The liquor was drained off, after which the hides were delimed for 60 minutes with 30% of water at 35° C., 0.15% of formic acid, 4% of ammonium chloride and 0.8% of sodium bisulfite, followed by bating for 40 minutes with 0.3% of a standard bate (pH-value 8.4). A cross-section of the skins does not turn phenolphthalein red in color.

Corresponding pieces of hide, measuring about 8 × 30 cm, were comparatively pickled and chrome-tanned in the drumming machine described by E. Komarek and G. Mauthe in "Das Leder" 12 (1961), pp. 285–289, more especially page 287.

100 parts of cowhide of one piece A were pickled in the usual way in the drumming machine with 3 parts of sodium chloride, 0.7 part of formic acid and 0.4 part of sulfuric acid in the presence of 11% of water (pH 3.7). 9.78 parts of a powder form tanning mixture consisting of 613 parts of powder-form 33% basic chromium sulfate containing 26% of chromium oxide, 41 parts by weight of glutaric acid, 134 parts by weight of sodium glutarate, 69 parts by weight of dolomite, 123 parts by weight of polyester B and 20 parts by weight of nonyl phenol, onto which 30 ethylene oxide groups had been polymerized, were added to the pickling liquor. The tanning time was 10 hours. The final temperature was 40° C. and the consumption level 0.7 g of $Cr_2O_3$.

100 parts of cowhide of the corresponding piece B are pickled in the drumming machine the same way as piece A. 6 parts by weight of a powder-form 33% basic chromium(III) sulfate containing 26% of chromium oxide were added to the pickling liquor. After 3 hours, 3.1 parts of a liquid product consisting of 935 parts by weight of polyester C and 65 parts by weight of nonyl phenol, onto which 30 ethylene oxide groups had been polymerized and 0.67 parts of dolomite were added. The tanning time was 10 hours. The final temperature was 40° C. and the consumption level 0.9 g of $Cr_2O_3$.

EXAMPLE 4

Cowhides (unsplit) limed in the usual way were washed for 10 minutes in a tanning vessel with 200% of water at 38° C., based on the weight of the hides. The solution was drained off, after which the hides were delimed for 60 minutes with 30% of water at 35° C., 0.15% of formic acid, 4% of ammonium chloride and 0.8% of sodium bisulfite, followed by bating for 40 minutes with 0.3% of a standard bate (pH-value 8.4). A cross-section of the hides did not turn phenolphthalein red in color.

100 parts of cowhide of one piece A were pickled in the usual way in a drumming machine with 3 parts of sodium chloride, 0.7 part of formic acid and 0.4 part of sulfuric acid in the presence of 11% of water (pH 3).

3 parts of a powder-form 33% basic chromium(III) sulfate containing 26% of chromium oxide and 5.8 parts of the tanning mixture described below were added to the pickling liquor.

The tanning mixture consists of 520 parts of powder-form 33% basic chromium sulfate containing 26% of chromium oxide, 140 parts of glutaric acid, 225 parts of sodium glutarate and 115 parts of dolomite.

100 parts of cowhide of the corresponding piece B were pickled in the same way as piece A. 9.78 parts of a powder-form tanning mixture were added to the pickling liquor. The tanning mixture consisted of 613 parts by weight of powder-form 33% basic chromium sulfate containing 26% of chromium oxide. 41 parts by weight of glutaric acid, 134 parts of sodium glutarate, 69 parts by weight of dolomite and 123 parts by weight of polyester D.

In order to determine the tanning rate, the tanning process in the drumming machine was interrupted and the comparable pieces of leather A and B were cut. Piece B was found to have tanned more quickly than piece A for the same pH-value of the residual liquors.

EXAMPLE 5

100 parts of limed cowhide, pre-tested as in Example 3, were pickled in the usual way in a drumming machine with 3 parts of sodium chloride, 0.7 part of formic acid and 0.4 part of sulfuric acid in the presence of 11% of water (pH 3).

3 parts of a powder-form 33% basic chromium(III) sulfate containing 26% of chromium oxide were introduced into the pickling liquor. After 1 hour, 3 parts of a powder-form 33% basic chromium(III) sulfate containing 26% of chromium oxide, 4.5 parts of polyester A and 0.67 part of dolomite were added, followed by drumming for 10 hours. The final temperature was 40° C. and the consumption level 1.9 g of $Cr_2O_3$/l.

EXAMPLE 6

100 parts of limed cowhide of one piece A, pretreated as in Example 3, were pickled in the usual way in a drumming machine with 3 parts of sodium chloride, 0.7 part of formic acid and 0.4 part of sulfuric acid in the presence of 11% of water (pH 3.7). 3 parts of a powder-form 33% basic chromium(III) sulfate containing 26% of chromium oxide were added to the pickling liquor. After 1 hour, 5.8 parts of the tanning mixture described below were added. The tanning mixture consisted of 520 parts by weight of powder-form 33% basic chromium sulfate containing 26% of chromium oxide, 115 parts by weight of dolomite, 140 parts by weight of glutaric acid and 225 parts by weight of sodium glutarate. The tanning time was 10 hours. The final temperature was 40° C. and the consumption level 0.9 g of $Cr_2O_3$/l.

100 parts of limed cowhide of the corresponding piece B were pickled in the drumming machine in the same way as piece A (pH 3.7).

9.78 parts of the tanning mixture described below were added to the pickling liquor. The tanning mixture consisted of 613 parts by weight of powder-form 33% basic chromium sulfate containing 26% of chromium oxide, 41 parts by weight of glutaric acid, 134 parts by weight of sodium glutarate, 69 parts by weight of dolomite, 123 parts by weight of polyester X-2 and 20 parts by weight of nonyl phenol onto which 30 ethylene oxide groups had been polymerized. The tanning time was 10 hours. The final temperature was 40° C. and the consumption level 0.87 g of $Cr_2O_3$/l.

Layer analysis produced the following values for the product containing polyester (% of Cr-distribution)
Grain — 37
Middle — 31
Flesh — 32

By contrast, the product without polyester produced the following values:
Grain — 40
Middle — 29
Flesh — 31

EXAMPLE 7

100 parts of limed cowhide of one piece A, pretreated as in Example 4, were pickled in the usual way in a drumming machine with 3 parts of sodium chloride, 0.7 part of formic acid and 0.4 part of sulfuric acid in the presence of 11% of water (pH 3.7).

100 parts of limed cowhide of the corresponding piece B were pickled in the same way as piece A. 9.78 parts of a powder-form tanning mixture were added to the pickling liquor. The tanning mixture consisted of 613 parts of powder-form 33% basic chromium sulfate containing 26% of chromium oxide, 41 parts by weight of glutaric acid, 134 parts by weight of sodium glutarate, 69 parts by weight of dolomite, 123 parts by weight of polyester X-1 and 20 parts by weight of nonyl phenol onto which 30 ethylene oxide groups had been polymerized.

The tanning time was 12 hours and the consumption level 0.75 g of $Cr_2O_3$ per liter.

The leather had a particularly mild feel.

EXAMPLE 8

100 parts of limed cowhide, pre-treated as described in Example 3, were pickled in the usual way in a drumming machine with 3 parts of sodium chloride, 0.7 part of formic acid and 0.4 part of sulfuric acid in the presence of 11% of water (pH 3.7).

3 parts of a powder-form 33% basic chromium(III) sulfate containing 26% of chromium oxide were added to the pickling liquor. After 1 hour, 3 parts of a powder-form 33% basic chromium(III) sulfate containing 26% of chromium oxide, 4.5 parts of polyester W and 0.67 part of dolomite were added, followed by drumming for 10 hours. The final temperature was 40° C. and the consumption level 2.6 g of $Cr_2O_3$/l.

Tanning produced a very soft leather.

EXAMPLE 9

100 parts of limed cowhide, pretreated as described in Example 3, were pickled in the usual way in a drumming machine with 3 parts of sodium chloride, 0.7 part of formic acid and 0.4 part of sulfuric acid in the presence of 11% of water (pH 3.7).

3 parts of a powder-form 33% basic chromium(III) sulfate containing 26% of chromium oxide were added to the pickling liquor. After 1 hour, 3 parts of a powder-form 33% basic chromium(III) sulfate containing 26% of chromium oxide and 4.5 parts of polyester O were added, followed by drumming for 5 hours at 40° C. 0.67 part of dolomite were then added, followed by drumming for another 5 hours. Subsequently 0.67 part of dolomite was added, followed by drumming for another 5 hours. The consumption level amounted to 2.0 g of $Cr_2O_3$/l.

Tanning produced a very soft leather.

EXAMPLE 10

100 parts of limed cowhide, pretreated as described in Example 3, were pickled in the usual way in a drumming machine with 3 parts of sodium chloride, 0.7 part of formic acid and 0.4, part of sulfuric acid in the presence of 11% of water (pH 3.7). 6 parts of a powder-form 33% basic chromium(III) sulfate containing 26% of chromium oxide were added to the pickling liquor. After 3 hours, 3.78 parts of the tanning mixture described below were added. The tanning mixture consisted of 106 parts by weight of glutaric acid, 347 parts by weight of sodium glutarate, 177 parts by weight of dolomite, 317 parts by weight of polyester Q and 53 parts by weight of nonyl phenol, onto which 30 ethylene oxide groups had been polymerized. The tanning time was 12 hours. The final temperature was 40° C. and the consumption level 0.46 g of $Cr_2O_3$/l.

EXAMPLE 11

100 parts of limed cowhide, pretreated as described in Example 3, were pickled in the usual way in a drumming machine with 3 parts of sodium chloride, 0.7 part of formic acid and 0.4 part of sulfuric acid in the presence of 11% of water (pH 3.7). 6 parts of a powder form 33% basic chromium(III) sulfate containing 26% of chromium oxide were added to the pickling liquor. After 3 hours, 3.78 parts of the tanning mixture, described below, were added. The tanning mixture consisted of 106 parts by weight of glutaric acid, 347 parts by weight of sodium glutarate, 177 parts by weight of dolomite, 317 parts by weight of polyester R and 53 parts by weight of nonyl phenol onto which 30 ethylene oxide groups had been polymerized. The tanning time was 12 hours. The final temperature was 40° C. and the consumption level 0.30 g of $Cr_2O_3$/l.

EXAMPLE 12

100 parts of limed cowhide, pretreated as in Example 3, were pickled in the usual way in a drumming machine with 3 parts of sodium chloride, 0.7 part of formic acid and 0.4 part of sulfuric acid in the presence of 11% of water (pH 3.7). 6 parts of a powder-form 33% basic chromium(III) sulfate containing 26% of chromium oxide were added to the pickling liquor. After 3 hours, 3.78 parts of the tanning mixture described below were added. The tanning mixture consisted of 106 parts by weight of glutaric acid, 347 parts by weight of sodium glutarate, 177 parts by weight of dolomite, 317 parts of polyester T and 53 parts by weight of nonyl phenol onto which 30 ethylene oxide groups had been polymerized. The tanning time was 12 hours. The final temperature was 40° C. and the consumption level 0.46 g of $Cr_2O_3$/l.

EXAMPLE 13

100 parts of limed cowhide, pretreated as described in Example 3, were pickled in the usual way in a drumming machine with 3 parts of sodium chloride, 0.7 part of formic acid and 0.4 part of sulfuric acid in the presence of 11% of water (pH 3.7). 6 parts of a powder-form 33% basic chromium(III) sulfate containing 26% of chromium oxide were added to the pickling liquor. After 3 hours, 378 parts of the tanning mixture described below were added. The tanning mixture consisted of 106 parts by weight of glutaric acid, 347 parts by weight of sodium glutarate, 177 parts by weight of dolomite, 317 parts by weight of polyester X-3 and 53 parts by weight of nonyl phenol onto which 10 ethylene oxide groups had been polymerized. The tanning time was 12 hours. The final temperature is 40° C. and the consumption level 0.51 g of $Cr_2O_3$/l.

EXAMPLE 14

100 parts of limed cowhide, pretreated as described in Example 3, were pickled in the usual way in a drumming machine with 3 parts of sodium chloride, 0.7 part of formic acid and 0.4, part of sulfuric acid in the presence of 11% of water (pH 3.7). 6 parts of a powder-form 33% basic chromium(III) sulfate containing 26% of chromium oxide were added to the pickling liquor. After 3 hours, 2.9 parts of polyester E-3, 0.67 part of dolomite and 0.2 part of nonyl phenol onto which 80 ethylene oxide groups had been polymerized were added. The tanning time was 12 hours. The final temperature was 40° C. and the consumption level 0.455 g of $Cr_2O_3$/l.

EXAMPLE 15

100 parts of limed cowhide, pretreated as described in Example 3, were pickled in the usual way in a tanning vessel with 3 parts of sodium chloride, 0.7 part of formic acid and 0.4 part of sulfuric acid in the presence of 11% of water (pH 3.7).

9.78% of a powder-form tanning mixture consisting of 479 parts by weight of powder-form 33% basic chromium sulfate containing 26% of chromium oxide, 33 parts by weight of glutaric acid, 108 parts by weight of sodium glutarate, 55 parts by weight of dolomite, 290 parts by weight of polyester W and 17 parts by weight of polyester W and 17 parts by weight of an emulsifier based on a reaction product of stearyl isocyanate with diethanolamine, were added to the pickling liquor, followed by drumming for 16 hours. The final temperature was 38° C., the final pH-value was 4.3 and the residual liquor contained 0.3 g of $Cr_2O_3$/l.

EXAMPLE 16

100 parts of limed cowhide, pretreated as described in Example 3, were pickled in the usual way in a tanning vessel with sodium chloride, sulfuric acid and/or formic acid in the presence of 40 parts of water (pH 4.0). 6 parts of a powder-form 33% basic chromium(III) sulfate were added to the pickling liquor. After 1 hour, 0.7 part of sodium carbonate (dissolved 1:10 in water) was added over a period of 1 hour. After 3 hours, 2.9 parts of polyester E-3 were added, followed by drumming for another 6 hours. The tanning temperature was 38° C., the final pH-value was 4.35 and the residual liquor contained 1.47 g of $Cr_2O_3$/l.

EXAMPLE 17

Cattle-hides (unsplit), lime in the usual way, are washed for 10 minutes in the tanning bottle with 200% water of 38° C., based on the weight of the hides. The liquor is drawn off and then deliming takes place for 35 minutes with 3.5% ammonium sulfate and 1% sodium sulfite; 50% water of 35° C. and 0.2% formic acid are added and deliming is continued for another 20 minutes, after which bating is conducted for 20 minutes with 0.5% of a commercially available bating agent (pH value of the dye liquor = 7.9). The cross-section of the hide no longer exhibits any red coloring on application of phenolphthalein.

100 parts cattle-hide of the one piece A are pickled with 3 parts rock salt, 3 parts polyacrylic acid, and 0.2 parts sulfuric acid on the drumming machine in the usual way, using 11% water (pH 3.5).

6 parts of a powdery, 33% basic chrome-(III)-sulfate with a content of 26% chromium oxide are added to the pickling liquor and after 2 hours of pickling 0.67 parts of dolomite are added and drumming is conducted for 10 hours. Final temperature 40° C., final pH-value 4.05. The residue in the liquor is 0.13 g $Cr_2O_3$ per liter.

100 parts cattle-hide of the corresponding piece B are pickled with 3 parts cooking salt, 0.7 parts formic acid and 0.4 parts sulfuric acid on the drumming machine in the usual way, using 11% water (pH 3.5).

6 parts of a powdery, 33% basic chromium-(III)-sulfate with a chromium oxide content of 26% are added to the pickling liquor and after 2 hours of pickling 0.8 parts glutaric acid, 1.31 parts sodium glutarate and 0.67 parts dolomite are added and drumming is conducted for 10 hours. Final temperature 40° C., final pH 3.95. The residue in the liquor is 0.76 g $Cr_2O_3$ per liter.

EXAMPLE 18

According to the French Patent Specification 1 572 572 a condensation product was prepared with the following composition:

| | | |
|---|---|---|
| 4 mols | salicylic acid | |
| 3 mols | formaldehyde | |
| 276 g | salicylic acid | |
| 50 g | water | mixed |
| 12 g | 100% strength sulfuric acid | mixed |
| 150 g | formaldehyde (30%) | |

are boiled for 15 hours at 100° C. with refluxing; a granular precipitate forms which are dissolved in
190 g — 45% strength caustic soda solution.
The solution is brought to a pH of 6.5 and
100 g — water is added; a clear solution is obtained.

Yield: 778 g. Concentration: ~50%.

100 parts cattle-hide, pretreated as in Example 3, are pickled with 3 parts rock salt, 0.7 parts formic acid and 0.6 parts sulfuric acid on the drumming machine with 11% water in the usual way (pH 3.7).

6 parts of a powdery, 33% basic chrome-(III)-sulfate with a chromium oxide content of 26% are added to the pickling liquor. After pickling for 2 hours 6 parts of the above-mentioned condensation product and 0.67 parts dolomite are added and drumming is continued for a further 10 hours. Final temperature 40° C., residue in the liquor 3.0 g chromium oxide per liter.

It will be appreciated that the instant specification and examples are set forth by way of illustration and not limitation, and that various modifications and changes may be made without departing from the spirit and scope of the present invention.

What is claimed is:

1. In the tanning or re-tanning of a hide with a tanning composition comprising a tanning-active substance and a Cr(III) salt, the improvement which comprises employing as said tanning-active substance a polycarboxylic acid compound which has been reacted to give a partial ester, urethane or amide.

2. A process as claimed in claim 1, wherein the tanning-active substance has a molecular weight of from about 170 to 30,000.

3. A process as claimed in claim 1, wherein the tanning-active substance is used in a quantity of from about 0.1 to 100% based on the weight of the hides.

4. A process as claimed in claim 3, wherein the tanning-active substance has a molecular weight from about 310 to 10,000.

5. A tanning composition comprising a polycarboxylic acid compound which has been reacted to give a partial ester, urethane or amide, and a Cr(III) salt.

6. A tanning composition according to claim 5, wherein the polycarboxylic acid compound has a molecular weight of from about 170 to 30,000.

7. A tanning composition according to claim 5, wherein the polycarboxylic acid compound has a molecular weight of from about 310 to 10,000.

* * * * *

UNITED STATES PATENT AND TRADEMARK OFFICE

CERTIFICATE OF CORRECTION

PATENT NO. : 4,126,413

DATED : November 21, 1978

INVENTOR(S) : Harro Träubel et al

It is certified that error appears in the above-identified patent and that said Letters Patent are hereby corrected as shown below:

Title Page Priority Insert --Foreign Application Priority Date June 12, 1976 [DE] Fed. Rep. of Germany... 2626430--..

Signed and Sealed this

Nineteenth Day of May 1981

[SEAL]

Attest:

RENE D. TEGTMEYER

Attesting Officer

Acting Commissioner of Patents and Trademarks